US010651001B2

(12) United States Patent
Takahashi et al.

(10) Patent No.: US 10,651,001 B2
(45) **Date of Patent: *May 12, 2020**

(54) FIELD EMISSION DEVICE AND FIELD EMISSION METHOD

(71) Applicant: MEIDENSHA CORPORATION, Tokyo (JP)

(72) Inventors: Daizo Takahashi, Numazu (JP); Michihiro Hatanaka, San Jose, CA (US)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/312,565

(22) PCT Filed: Mar. 16, 2017

(86) PCT No.: PCT/JP2017/010551

§ 371 (c)(1),
(2) Date: Dec. 21, 2018

(87) PCT Pub. No.: WO2017/221479

PCT Pub. Date: Dec. 28, 2017

(65) Prior Publication Data

US 2019/0333730 A1 Oct. 31, 2019

(30) Foreign Application Priority Data

Jun. 24, 2016 (JP) ..... 2016-125036

(51) Int. Cl.
*H01J 1/14* (2006.01)
*H01J 35/06* (2006.01)
(Continued)

(52) U.S. Cl.
CPC ..... *H01J 35/065* (2013.01); *H01J 1/3044* (2013.01); *H01J 3/021* (2013.01); *H01J 7/18* (2013.01);
(Continued)

(58) Field of Classification Search
None
See application file for complete search history.

(56) References Cited

U.S. PATENT DOCUMENTS 3,303,372 A 2/1967 Gager
4,679,219 A 7/1987 Ozaki
(Continued)

FOREIGN PATENT DOCUMENTS

JP 54-093375 U1 7/1979
JP 61-062344 U 4/1986
(Continued)

OTHER PUBLICATIONS

Japanese Office Action and English translation, dated May 16, 2017, 9 pages.
(Continued)

*Primary Examiner* — Vip Patel
(74) *Attorney, Agent, or Firm* — Foley & Lardner LLP

(57) ABSTRACT

An emitter (3) and a target (7) are arranged so as to face each other in a vacuum chamber (1), and a guard electrode (5) is provided at an outer circumferential side of an electron generating portion (31) of the emitter (3). The emitter (3) is supported movably in both end directions of the vacuum chamber (1) by the emitter supporting unit (4) having a movable body (40). The emitter supporting unit (4) is operated by an operating unit (6) connected to the emitter supporting unit (4). By operating the emitter supporting unit (4) by the operating unit (6), a distance between the electron generating portion (31) of the emitter (3) and the target (7)
(Continued)

is changed, and a position of the emitter (3) is fixed at an arbitrary distance, then field emission is performed with the position of the emitter (3) fixed.

11 Claims, 4 Drawing Sheets

(51) Int. Cl.

| | |
|---|---|
| ***H01J 1/304*** | (2006.01) |
| ***H01J 3/02*** | (2006.01) |
| ***H01J 7/18*** | (2006.01) |
| ***H01J 35/12*** | (2006.01) |

(52) U.S. Cl.
CPC ..... *H01J 35/12* (2013.01); *H01J 2201/30453* (2013.01)

(56) References Cited

U.S. PATENT DOCUMENTS

| | | | | |
|---|---|---|---|---|
| 4,912,739 | A | 3/1990 | Weiss | |
| 7,085,351 | B2 | 8/2006 | Lu et al. | |
| 7,965,818 | B2 | 6/2011 | Jaafar et al. | |
| 8,005,191 | B2 | 8/2011 | Jaafar et al. | |
| 8,378,561 | B2 | 2/2013 | Ishiguro et al. | |
| 8,761,344 | B2 | 6/2014 | Reynolds et al. | |
| 8,913,719 | B2 | 12/2014 | Kuribayashi et al. | |
| 10,068,741 | B2 * | 9/2018 | Takahashi | H01J 35/16 |
| 2004/0028183 | A1 | 2/2004 | Lu et al. | |
| 2006/0274889 | A1 | 12/2006 | Lu et al. | |
| 2007/0046166 | A1 | 3/2007 | Okada et al. | |
| 2010/0002840 | A1 | 1/2010 | Jaafar et al. | |
| 2011/0115363 | A1 | 5/2011 | Ishiguro et al. | |
| 2011/0142193 | A1 | 6/2011 | Frontera et al. | |
| 2011/0305314 | A1 | 12/2011 | Kitamura et al. | |
| 2012/0027177 | A1 | 2/2012 | Ogata et al. | |
| 2012/0194057 | A1 | 8/2012 | Suzuki et al. | |
| 2013/0259197 | A1 | 10/2013 | Kuribayashi et al. | |
| 2019/0214215 | A1 * | 7/2019 | Takahashi | H01J 35/06 |

FOREIGN PATENT DOCUMENTS

| | | | |
|---|---|---|---|
| JP | 3-156846 | A | 7/1991 |
| JP | 2005-346942 | A | 12/2005 |
| JP | 2008-150253 | A | 7/2008 |
| JP | 2008-166059 | A | 7/2008 |
| JP | 2008-311174 | A | 12/2008 |
| JP | 2010-056062 | A | 3/2010 |
| JP | 2010-186694 | A | 8/2010 |
| JP | 2011-8998 | A | 1/2011 |
| JP | 2011-119084 | | 6/2011 |
| JP | 2011-258470 | A | 12/2011 |
| JP | 2012-049122 | A | 3/2012 |
| JP | 2013-225490 | A | 10/2013 |
| KR | 10-2016-0058582 | A | 5/2016 |
| WO | WO 03/080180 | A1 | 10/2003 |
| WO | WO 2010/013772 | A1 | 2/2010 |
| WO | WO 2016/104484 | A1 | 6/2016 |

OTHER PUBLICATIONS

Korean Office Action and English translation, Application No. 10-2019-7000030, dated Feb. 15, 2019, 7 pages.
Korean Office Action and English translation, Application No. 10-2019-7001913, dated Feb. 25, 2019, 7 pages.
U.S. Appl. No. 16/309,238, filed Dec. 12, 2018, Meidensha Corporation.
U.S. Appl. No. 16/311,985, filed Dec. 20, 2018, Meidensha Corporation.
Japanese Office Action and English translation, dated May 15, 2017.
USPTO Notice of Allowance, U.S. Appl. No. 16/311,985, dated May 15, 2019, 12 pages.
Amendment and English translation, dated Feb. 17, 2017, 7 pages.
Japanese Office Action and English translation, dated Dec. 20, 2016, 7 pages.
Korean Office Action, dated Aug. 7, 2017, 3 pages.
Notice of Allowance and English translation, dated Mar. 26, 2011, 4 pages.
Written Argument to Japanese Office Action and English translation, dated Feb. 17, 2017, 5 pages.
USPTO Notice of Allowance, U.S. Appl. No. 16/309,238 dated Nov. 21, 2019, 18 pages.

* cited by examiner

FIELD EMISSION DEVICE AND FIELD EMISSION METHOD

TECHNICAL FIELD

The present invention relates to a field emission device (an electric field radiation device) and a field emission method (an electric field radiation method) that are applied to various devices such as an X-ray apparatus, an electron tube and a lighting system.

BACKGROUND ART

As an example of the electric field radiation device applied to various devices such as the X-ray apparatus, the electron tube and the lighting system, there has been known a configuration in which voltage is applied between an emitter (an electron source formed of carbon etc.) and a target which are positioned (which are separated at a predetermined distance) while facing to each other in a vacuum chamber of a vacuum enclosure, an electron beam is emitted by field emission (by generation of electrons and emission of the electrons) of the emitter, and by colliding the emitted electron beam with the target, a desired function (for instance, in the case of the X-ray apparatus, a radioscopy resolution by external emission of X-ray) is obtained.

Further, suppression of dispersion of the electron beam emitted from the emitter, for instance, by employing a triode structure formed with a grid electrode interposed between the emitter and the target, and/or by shaping a surface of an electron generating portion (a portion that is positioned at an opposite side to the target and generates electrons) of the emitter into a curved surface, and/or by arranging a guard electrode, which is at the same potential as the emitter, at an outer circumferential side of the emitter, has been discussed (e.g. Patent Documents 1 and 2).

It is desirable that the electron beam be emitted by generating the electrons from only the electron generating portion of the emitter by the above application of voltage. However, if an undesired minute protrusion or dirt etc. exists in the vacuum chamber, an unintentional flashover phenomenon easily occurs, and a withstand voltage performance cannot be obtained, then a desired function may not be able to be obtained.

This is, for instance, a case where a portion at which a local electric field concentration easily occurs (e.g. a minute protrusion formed during working process) is formed at the guard electrode etc. (the target, the grid electrode and the guard electrode, hereinafter, simply called the guard electrode etc., as necessary), a case where the guard electrode etc. adsorb gas component (e.g. a residual gas component in the vacuum enclosure) and a case where an element causing the electron to be easily generated is contained in materials applied to the guard electrode etc. In these cases, the electron generating portion is formed also at the guard electrode etc., and a quantity of generation of the electron becomes unstable, then the electron beam easily disperses. For instance, in the case of the X-ray apparatus, there is a risk that X-ray will be out of focus.

Therefore, as a method of suppressing the flashover phenomenon (as a method of stabilizing the quantity of generation of the electron), for instance, a method of performing a voltage discharge conditioning process (regeneration (reforming); hereinafter, simply called a regeneration process, as necessary) that applies voltage (high voltage) across the guard electrode etc. (e.g. between the guard electrode and the grid electrode) and repeats discharge, has been studied.

CITATION LIST

Patent Document

Patent Document 1: Japanese Unexamined Patent Application Publication No. 2008-150253
Patent Document 2: Japanese Unexamined Patent Application Publication No. 2011-008998

SUMMARY OF THE INVENTION

However, when the voltage of the regeneration process is merely applied across the guard electrode etc., field emission (e.g. field emission before performing the regeneration process) of the emitter also easily occurs, then there is a risk that the guard electrode etc. will not properly undergo the regeneration process.

The present invention was made in view of the above technical problem. An object of the present invention is therefore to provide a technique that is capable of performing the regeneration process of the guard electrode etc. while suppressing the field emission of the emitter, readily setting an output of a field emission current and contributing to an improvement in characteristics of the electric field radiation.

The electric field radiation device and the field emission method according to the present invention are those that can solve the above problem. As one aspect of the electric field radiation device, an electric field radiation device comprises: a vacuum enclosure formed by sealing both end sides of a tubular insulator and having a vacuum chamber at an inner wall side of the insulator; an emitter positioned at one end side of the vacuum chamber and having an electron generating portion that faces to the other end side of the vacuum chamber; a guard electrode arranged at an outer circumferential side of the electron generating portion of the emitter; a target positioned at the other end side of the vacuum chamber and provided so as to face to the electron generating portion of the emitter; a movable emitter supporting unit supporting the emitter movably in both end directions of the vacuum chamber; and an operating unit connected to the emitter supporting unit and operating the emitter supporting unit, and the operating unit being configured to change a distance between the electron generating portion of the emitter and the target and fix a position of the emitter at an arbitrary distance by operation of the emitter supporting unit by the operating unit, and field emission being performed by the electron generating portion of the emitter with the position of the emitter fixed.

The emitter supporting unit supports the emitter through a movable body that is movable, by the operating unit, in the both end directions of the vacuum chamber, the operating unit has an adjustment screw portion whose screw shaft is screwed into and connected to one end side of the movable body so as to extend in the same direction as an axis of the movable body and rotatably retained by the one end side of the movable body, and the movable body moves in the both end directions by turning of the adjustment screw portion by the operating unit, the distance between the electron generating portion of the emitter and the target is changed, and the position of the emitter is fixed at the arbitrary distance. Further, a motor for turning the adjustment screw portion is connected to the adjustment screw portion through an insulator.

The emitter supporting unit supports the emitter through a movable body that is movable, by the operating unit, in the both end directions of the vacuum chamber, the operating unit has a piston that can reciprocate along an axis of the movable body and that is connected to one end side of the movable body, and the movable body moves in the both end directions by reciprocating motion of the piston by the operating unit, the distance between the electron generating portion of the emitter and the target is changed, and the position of the emitter is fixed at the arbitrary distance. Further, the piston is connected to the movable body through an insulator.

The movable body has a shape that extends in the both end directions of the vacuum chamber at an opposite side to the electron generating portion of the emitter.

The guard electrode is provided, at a target side thereof, with a small diameter portion. Further, the guard electrode is provided, at a target side thereof, with an edge portion that extends in a crossing direction of the vacuum chamber and overlaps with a circumferential edge portion of the electron generating portion of the emitter in the both end directions of the vacuum chamber.

The electric field radiation device further comprises bellows that can expand and contract in the both end directions of the vacuum chamber. And, one end side of the bellows is retained by the emitter supporting unit, and the other end side of the bellows is retained by the vacuum enclosure.

A grid electrode is provided between the emitter and the target in the vacuum chamber.

As one aspect of the field emission method of the electric field radiation device, a field emission method comprises: setting an output of a field emission current by changing the distance between the electron generating portion of the emitter and the target and by fixing the position of the emitter at the arbitrary distance by operation of the operating unit; and performing field emission from the electron generating portion of the emitter with the position of the emitter fixed. Further, the output of the field emission current is set without changing a tube voltage.

According to the present invention described above, it is possible to perform the regeneration process of the guard electrode etc. while suppressing the field emission of the emitter, readily set the output of the field emission current and contribute to an improvement in characteristics of the electric field radiation device.

BRIEF DESCRIPTION OF THE DRAWINGS

(FIG. 4A: the discharge distance d is 0, FIG. 4B: the discharge distance d is a predetermined distance).

EMBODIMENTS FOR CARRYING OUT THE INVENTION

Figure 1:
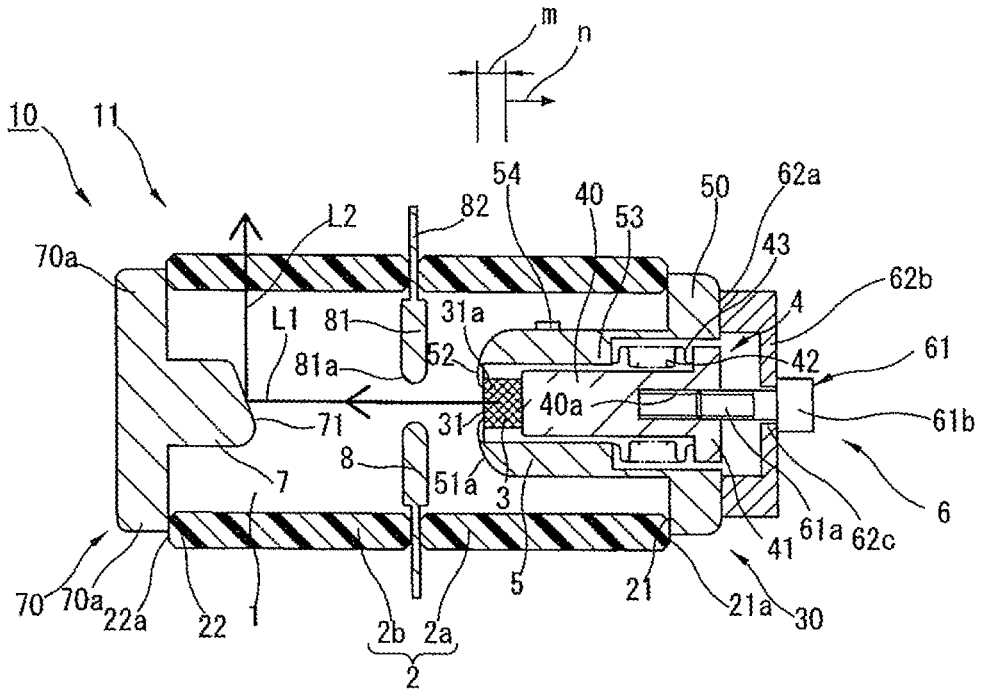
FIG. 1 is a schematic explanatory drawing showing an X-ray apparatus 10 according to an embodiment of the present invention (a sectional view cut in both end directions of a vacuum chamber 1 (in a case where an emitter 3 is positioned in a dischargeable region m)).

An electric field radiation device according to an embodiment of the present invention is not an electric field radiation device merely having an emitter and a target which are positioned so as to face to each other and a guard electrode at an outer circumferential side of an electron generating portion of the emitter in a vacuum chamber formed by sealing both end sides of an insulator, but an electric field radiation device having a movable emitter supporting unit that supports the emitter movably in directions of both ends of the vacuum chamber (hereinafter, simply called both end directions) and configured to be able to change a distance between the electron generating portion of the emitter and a target by movement of the emitter supporting unit.

Further, the electric field radiation device according to the embodiment of the present invention has an operating unit that is connected to the emitter supporting unit (e.g. one end side of an after-mentioned movable body of the emitter supporting unit) and operates or actuates the emitter supporting unit, and is configured to be able to change the distance between the electron generating portion of the emitter and the target by operation of the operating unit and allow field emission from the electron generating portion of the emitter in a state in which a position of the emitter is fixed at an arbitrary distance.

As conventional regeneration processing method of the guard electrode etc., other than the method of applying high voltage across the guard electrode etc. as mentioned above, a method of removing adsorbed gas by exposing guard electrode etc. in a vacuum atmosphere has been known. This method is a method in which, for instance, an electric field radiation device (hereinafter, called a conventional device) is formed with a large diameter exhaust pipe being provided at a vacuum enclosure, and by bringing the vacuum chamber into a high temperature vacuum state through the large diameter exhaust pipe, the adsorbed gas of the guard electrode etc. in the vacuum chamber is released, and subsequently, the vacuum chamber is returned to an atmospheric state and the emitter etc. are arranged in the vacuum chamber through the large diameter exhaust pipe, then by sealing the vacuum chamber, the vacuum chamber is brought into the vacuum state again.

However, it is difficult to maintain the high temperature vacuum state of the vacuum chamber in the vacuum enclosure provided with the large diameter exhaust pipe for a long time. Further, there is a risk that gas will be re-adsorbed to the guard electrode etc. before the vacuum chamber is brought into the vacuum state again. Therefore, it is impossible to regenerate (smooth) a coarse surface formed at the guard electrode etc. In addition, the vacuum enclosure increases in size due to the large diameter exhaust pipe, also man-hour of manufacturing may increase and product cost may increase.

On the other hand, according to the configuration of the embodiment of the present invention, it is possible to perform the regeneration process of the guard electrode etc. without using the above-mentioned methods. To perform the regeneration process, by operating the operating unit and moving the emitter from a dischargeable region (a region in which the field emission is performed; a dischargeable region m in after-mentioned FIG. 1) to a no-discharge region (that is a discharge electric field or less; a no-discharge region n in FIG. 1) (i.e. moving the emitter in a direction in which a distance between the electron generating portion and the target becomes longer), a state in which the field emission of the emitter is suppressed (e.g. as shown in after-mentioned FIG. 2, a state in which the electron generating portion of the emitter and the guard electrode are separate from each other (a gap is formed between them)) is set. Then, in this state, by applying voltage across the guard electrode etc., the regeneration process can be performed, and surfaces of the guard electrode etc. melt or dissolve and are smoothed out. With this, a desired withstand voltage can be obtained. Further, in the state in which the field emission of the emitter is suppressed as described above, no load is applied to the emitter during the regeneration process.

Therefore, according to the regeneration process of the embodiment, even if the minute protrusion exists on the surfaces of the guard electrode etc., the surfaces can be smoothed. Further, in the case where gas component (e.g. the residual gas component in the vacuum enclosure) is adsorbed, the adsorbed gas is released. Moreover, in the case where the element causing the electron to be easily generated is contained in the guard electrode etc., by the above melt-smoothing, the element can be held or stored inside the guard electrode etc., and generation of the electrons, caused by the element, can be suppressed. Hence, the quantity of generation of the electron can be easily stabilized in the electric field radiation device.

After performing the regeneration process of the guard electrode etc. as described above, by operating the emitter supporting unit by the operating unit again and moving the emitter from the no-discharge region to the dischargeable region (i.e. moving the emitter in a direction in which the distance between the electron generating portion and the target becomes shorter), a state in which a distance between the electron generating portion of the emitter and the guard electrode is narrower (a state in which the electron generating portion of the emitter and the guard electrode are positioned close to each other or contact each other) is set. Then, the field emission of the emitter (the electron generating portion) can be possible, and a desired function of the electric field radiation device can be obtained (in the case of the X-ray apparatus, X-irradiation etc. can be obtained).

Here, assuming that a device difference such as a product yield is negligible, an output (an X-ray intensity etc.; hereinafter, simply called a current output, as necessary) of a field emission current (a flow of electron beam emitted from the emitter toward the target) is determined by a voltage value relating to the field emission by current-voltage characteristics.

As a method of adjusting and setting this current output to a desired magnitude, for instance, there is a conventional method in which these adjustment and setting are performed by changing a voltage (hereinafter, simply called an EG voltage, as necessary) applied between the emitter and a grid electrode. However, since a tube voltage (e.g. a total voltage of the EG voltage and an after-mentioned TG voltage) is also changed before and after the adjustment, if the change of the tube voltage is not desirable for utilization of the electric field radiation device (the X-ray apparatus), this method is improper. Further, in this conventional method, by changing the EG voltage and the voltage applied between the target and the grid electrode (hereinafter, simply called the TGO voltage, as necessary) while controlling (feedback-controlling) both of the EG voltage and the TGvoltage, the change of the tube voltage may be suppressed. However, there is a risk that the adjustment of the current output will become complicated. Moreover, in a case where the electric field radiation device has no grid electrode, since the field emission current greatly dependents on the tube voltage, it may be difficult to adjust the current output while suppressing the change of the tube voltage by the conventional method.

On the other hand, in the embodiment of the present invention, when moving the emitter to the dischargeable region by operating the emitter supporting unit by the operating unit, a distance between the electron generating portion of the emitter and the guard electrode (hereinafter, simply called a discharge distance, as necessary; which is d in an after-mentioned FIG. 4B) can be changed according to a width in both end directions of the dischargeable region (a width of the dischargeable region m in FIG. 1 etc.). Electric field relating to the emitter is also different depending on a length of this discharge distance. For instance, as the discharge distance is longer (as the emitter gets closer to one end side in the dischargeable region), the electric field becomes smaller. And, as the discharge distance is shorter (as the emitter gets closer to the other end side in the dischargeable region), the electric field becomes greater. Then, the current output whose magnitude is dependent on the electric field described above is generated.

That is, according to the embodiment of the present invention, by properly changing the discharge distance through the operating unit, even if the electric field radiation device has no grid electrode, it is possible to readily adjust and set the current output to a desired magnitude (more readily than the conventional method) while suppressing the change of the tube voltage (while keeping the tube voltage at a certain voltage) so that the tube voltage does not change. Further, since there is no limit on utilization of the pros and cons of the change of the tube voltage, it is possible to contribute to an improvement in general versatility of the electric field radiation device.

In a case of the utilization that allows the change of the tube voltage, in the embodiment of the present invention, not only the discharge distance is merely changed as described above, but also the EG voltage and the tube voltage could be changed and a tube voltage control could be performed as necessary by combining the conventional method. With this, an adjustment range of the current output becomes wider than that of the conventional method, and this further contributes to the improvement in general versatility of the electric field radiation device. For instance, even in a case where field emission characteristics are different from a product specification due to the device difference such as the product yield, by performing the adjustment of the current output, like the embodiment of the present invention, it is possible to obtain the field emission characteristics equivalent to the product specification.

The electric field radiation device of the present embodiment can be variously modified by properly applying common general technical knowledge of each technical field as long as the electric field radiation device has the emitter supporting unit supporting the emitter movably in the both end directions and the operating unit connected to the emitter supporting unit and operating (actuating) the emitter supporting unit and is configured to be able to change the distance between the electron generating portion of the emitter and the target and adjust and set the current output to the desired magnitude by changing the discharge distance. Examples of the electric field radiation device will be explained below.

Embodiment 1 of Electric Field Radiation Device

Figure 2:
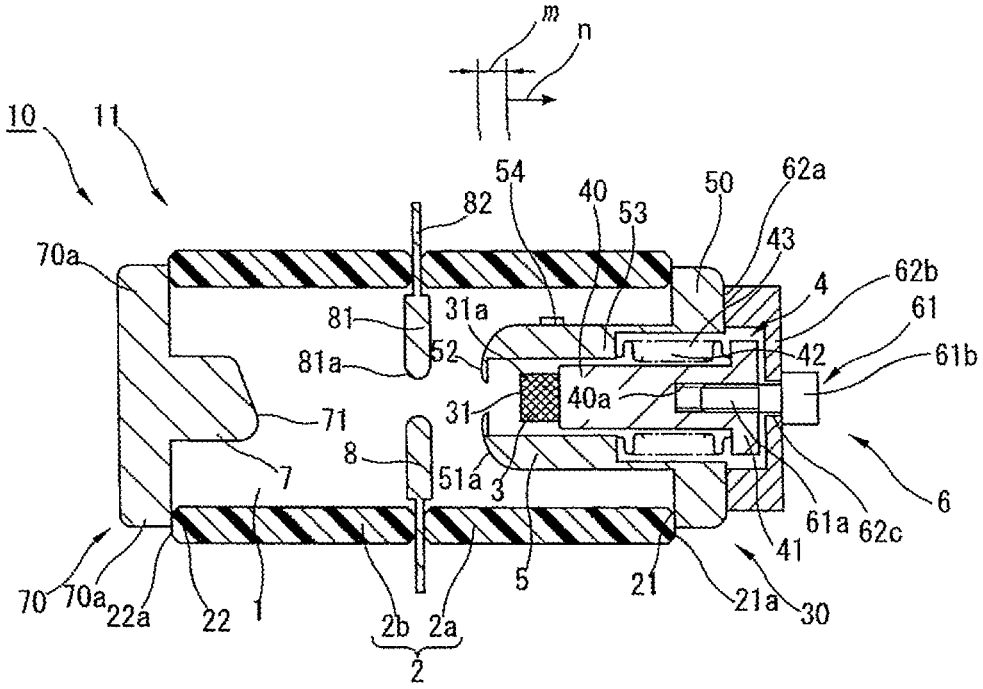
FIG. 2 is a schematic explanatory drawing showing the X-ray apparatus 10 according to the embodiment of the present invention (a sectional view cut in both end directions of the vacuum chamber 1 (in a case where the emitter 3 is positioned in a no-discharge region n)).

A reference sign 10 in FIGS. 1 and 2 is an example of an X-ray apparatus to which the electric field radiation device of the present embodiment is applied. In this X-ray apparatus 10, an opening 21 at one end side of a tubular insulator 2 and an opening 22 at the other end side are sealed with an emitter unit 30 and a target unit 70 respectively (e.g. by brazing), and a vacuum enclosure 11 having a vacuum chamber 1 at an inner wall side of the insulator 2 is defined. Between the emitter unit 30 (an after-mentioned emitter 3) and the target unit 70 (an after-mentioned target 7), a grid electrode 8 that extends in a crossing direction of the vacuum chamber 1 (a direction crossing the both end directions, hereinafter, simply called crossing direction) is provided.

The insulator 2 is formed of insulation material such as ceramic. As the insulator 2, various shapes or forms can be employed as long as they can isolate the emitter unit 30 (the emitter 3) and the target unit 70 (the target 7) from each other and form the vacuum chamber 1 inside them. For instance, as shown in the drawings, it is a configuration in which the grid electrode 8 (e.g. a lead terminal 82) is interposed between concentrically-arranged two tubular insulation members 2*a* and 2*b* and the both insulation members 2*a* and 2*b* are fixed together by brazing etc.

The emitter unit 30 has the emitter 3 having, at a portion facing to the target unit 70 (the target 7), an electron generating portion 31, a movable emitter supporting unit 4 supporting the emitter 3 movably in the both end directions of the vacuum chamber 1, a guard electrode 5 arranged at an outer circumferential side of the electron generating portion 31 of the emitter 3. An operating unit 6 for operating or actuating the emitter supporting unit 4 is connected to the emitter supporting unit 4.

As the emitter 3, various shapes or forms can be employed as long as they have the electron generating portion 31 as described above and electrons are generated from the electron generating portion 31 by application of voltage and also as shown in the drawings they can emit an electron beam L1 (as a radiator or an emitter). For instance, it is made of material of carbon etc. (carbon nanotube etc.), and as shown in the drawings, a solid emitter or a thin-film emitter formed by evaporation is used as the emitter 3. As the electron generating portion 31, it is preferable to shape a surface, facing to the target unit 70 (the target 7), of the electron generating portion 31 into a concave shape (a curved shape) in order for the electron beam L1 to easily converge.

As the emitter supporting unit 4, various shapes or forms can be employed as long as they can support the emitter 3 movably in the both end directions as described above and move by operation of the operating unit 6. For instance, it is a configuration having the columnar movable body 40, which extends in the both end directions at an inner side of the guard electrode 5 and has at one end side thereof (i.e. at the opening 21 side) a flange portion 41 and supports the emitter 3 at the other end side (i.e. at the opening 22 side) (for instance, an opposite side to the electron generating portion 31 of the emitter 3 is fixed to the other end side of the movable body 40 by crimping, swaging or welding and so on), and bellows 42 which can expand and contract in the both end directions and are retained by the vacuum enclosure 11 (for instance, as shown in the drawings, the bellows 42 are retained by the insulator 2 through the guard electrode 5).

In the case of the emitter supporting unit 4 provided with the movable body 40 and the bellows 42 as described above, by operating (actuating) the emitter supporting unit 4 by the operating unit 6, the movable body 40 moves in the both end directions with the bellows 42 expanding and contracting, and consequently, the emitter 3 also moves in the both end directions. The emitter supporting unit 4 can be formed of various material, and material is not especially limited. For instance, the emitter supporting unit 4 could be formed of conductive metal material such as stainless (SUS material etc.) and copper.

As the bellows 42, various shapes or forms can be employed as long as they can expand and contract in the both end directions. For instance, the bellows could be molded by working of metal material such as metal sheet or metal plate. As an example, as shown in the drawings, the bellows 42 have a bellow tubular wall 43 that extends in the both end directions so as to surround or cover an outer circumferential side of the movable body 40.

As a retaining structure of the bellows 42 in the drawings, one end side of the bellows 42 is fixed to the flange portion 41 of the movable body 40 by brazing etc., and the other end side of the bellows 42 is fixed to the inner side of the guard electrode 5 (in the drawings, the other end side of the bellows 42 is fixed to an after-mentioned stepped portion 53) by brazing etc. Then, the bellows 42 define the vacuum chamber 1 and the atmospheric side (the outer peripheral side of the vacuum enclosure 11), and can maintain air tightness of the vacuum chamber 1. However, fixing manner etc. of the bellows 42 are not limited to the above configuration. That is, as long as the one end side of the bellows 42 is retained by the emitter supporting unit 4 (e.g. by the movable body 40 or the flange portion 41) and the other end side of the bellows 42 is retained by the vacuum enclosure 11 (e.g. by the inner side of the guard electrode 5 or an after-mentioned flange portion 50) and also the bellows 42 can expand and contract in the both end directions as described above and can define the vacuum chamber 1 and the atmospheric side (the outer peripheral side of the vacuum enclosure 11) and also can maintain the air tightness of the vacuum chamber 1, various shapes or forms can be employed.

As the guard electrode 5, as long as the guard electrode 5 is arranged at the outer circumferential side of the electron generating portion 31 of the emitter 3 as described above and the electron generating portion 31 of the emitter 3 moved by and according to the movement of the emitter supporting unit 4 contacts and separates from the guard electrode 5 then, in a state in which the emitter 3 and the guard electrode 5 are positioned close to each other or contact each other (as shown in FIG. 1), the guard electrode 5 can suppress dispersion of the electron beam L1 emitted from the emitter 3, various shapes or forms can be employed.

As an example of the guard electrode 5, the guard electrode 5 is made of material of stainless (SUS material etc.), and has a tubular shape that extends in the both end directions of the vacuum chamber 1 at an outer circumferential side of the emitter 3. And, one end side of the guard electrode 5 is retained by an end surface 21*a* of the opening 21 of the insulator 2 through the flange portion 50 formed at the one end side in the both end directions of the guard electrode 5, and the other end side (i.e. the target 7 side) of the guard electrode 5 contacts and separates from the emitter 3.

Figure 3:
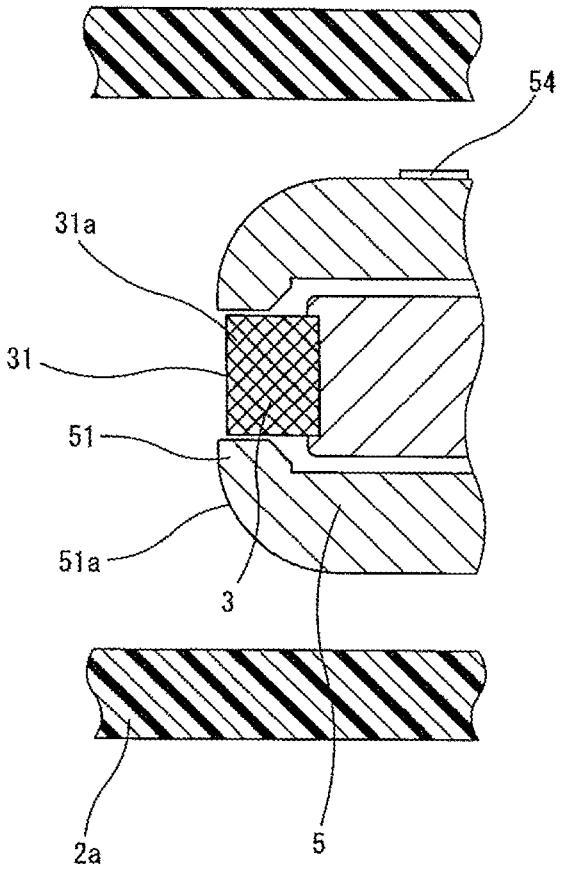
FIG. 3 is a schematic explanatory drawing showing an example of a guard electrode 5 of the embodiment (an enlarged view of a part of FIG. 1, where the guard electrode 5 has a small diameter portion 51 instead of an edge portion 52).

This configuration of the guard electrode 5 to contact and separate from the emitter 3 is not especially limited. For instance, as shown in FIG. 3, a configuration in which a small diameter portion 51 is formed at the other end side in the both end directions of the guard electrode 5 is conceivable. However, the configuration as shown in FIGS. 1 and 2, in which the edge portion 52 that extends inwards in the crossing direction of the vacuum chamber 1 and crosses or overlaps with the circumferential edge portion 31*a* of the electron generating portion 31 of the emitter 3 in the both end directions of the vacuum chamber 1 is formed, is raised. Further, both of the small diameter portion 51 and the edge portion 52 could be formed.

In such a contacting and separating configuration of the guard electrode 5, by the movement of the emitter supporting unit 4, the emitter 3 moves in the both end directions at the inner side (a tubular inner wall side) of the guard electrode 5, and the electron generating portion 31 of the emitter 3 contacts and separates from the small diameter portion 51 or the edge portion 52. Further, in the configuration in which the guard electrode 5 has the edge portion 52, when the emitter 3 is positioned close to or contacts the guard electrode 5, the circumferential edge portion 31*a* of the electron generating portion 31 is covered with and protected by the edge portion 52.

In the drawings, the guard electrode 5 has at the inner side thereof a shape whose diameter is reduced stepwise from one end side to the other end side of the guard electrode 5, and a stepped portion 53 is formed inside the guard electrode 5. Fixing the other end side of the bellows 42 to the stepped portion 53 facilitates a fixing work, and also a fixing structure is stable.

By the shape, like the guard electrode 5, whose diameter is reduced stepwise from the one end side to the other end side, the electron generating portion 31 of the emitter 3 moves inside the guard electrode 5 while being guided toward the small diameter portion 51 or the edge portion 52. Further, by the configuration of the guard electrode 5 as shown in the drawings, the bellows 42 are accommodated inside the guard electrode 5, and a physical shock from an outer peripheral side of the vacuum enclosure 11 to the bellows 42 can be suppressed (the bellows 42 can be protected and damage to the bellows 42 can be prevented). Moreover, this configuration contributes to size reduction of the X-ray apparatus 10.

Further, it is possible to employ such a shape as to suppress a local electric field concentration which could occur at the electron generating portion 31 (especially, at the circumferential edge portion 31*a*) and/or suppress the flashover occurring from the electron generating portion 31 to other portions, by enlarging an apparent radius of curvature of the circumferential edge portion 31*a* of the electron generating portion 31 of the emitter 3. For instance, as shown in the drawings, the guard electrode 5 has a shape having a curved surface port ion 51*a* at the other end side in the both end directions.

Here, in the case of the guard electrode 5 shown in the drawings, although a getter 54 is fixed to an outer circumferential side of the guard electrode 5 by welding, a fixing position and material of the getter 54 are not especially limited.

Figure 4A:
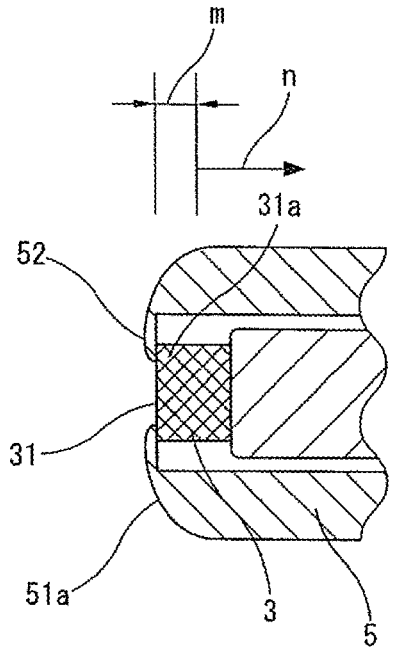
FIGS. 4A and 4B are schematic drawings for explaining a discharge distance d in the case where the emitter 3 is positioned in the dischargeable region m
Figure 4B:
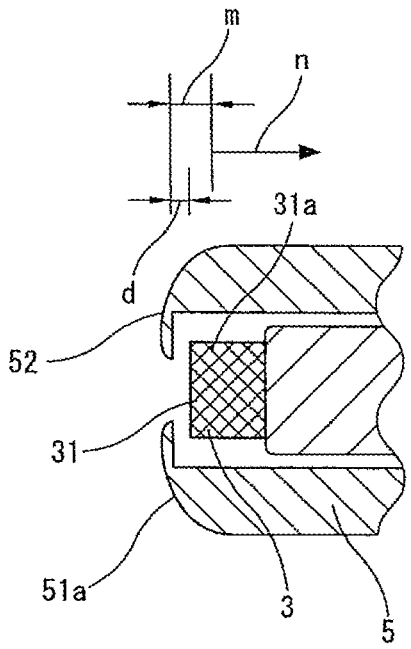

As the operating unit 6, various shapes or forms can be employed as long as they are connected to the emitter supporting unit 4 and can operate or actuate the emitter supporting unit 4 then change the distance between the electron generating portion 31 of the emitter 3 and the target 7 by the operation, and also move the emitter 3 so that the electron generating portion 31 of the emitter 3 is positioned in the dischargeable region m or the no-discharge region n then fix a position of the emitter 3, and further as shown in FIG. 4B, set the discharge distance d between the electron generating portion 31 and the guard electrode 5 to an arbitrary distance in the dischargeable region m.

For instance, the operating unit 6 shown in FIGS. 1 and 2 has an adjustment screw portion 61, such as a bolt, that is rotatably retained at one end side of the movable body 40 and a closed-bottomed tubular bearing portion 62 that rotatably retains the adjustment screw portion 61. And, the operating unit 6 has a screw mechanism in which a columnar male screw portion 61*a* that is located at a top end side (the target 7 side) of the adjustment screw portion 61 is screwed into and connected to a female screw hole 40*a* that is formed at the one end side of the movable body 40 and has therein a screw bore (a bore into which the male screw portion 61*a* is screwed) that extends in the same direction of an axis of the movable body 40.

The bearing portion 62 covers the one end side of the movable body 40 so as not to interfere with movement in the both end directions of the movable body 40, and an end surface 62*a* at a closed-bottomed tubular opening side of the bearing portion 62 is fixed to and retained by the flange portion 50 by brazing etc. Further, a portion of the adjustment screw portion 61 between a root side of the male screw portion 61*a* and a screw head 61*b* is rotatably retained by a bearing hole 62*c* that is formed so as to penetrate a bottom 62*b* of the bearing portion 62 along the screw bore. Furthermore, the screw head 61*b* of the adjustment screw portion 61 protrudes from one end side of the bearing hole 62*c* (to the one end side), and for instance, by grasping and operating the screw head 61*b* by an operator, the adjustment screw portion 61 can be turned in loosening and tightening directions.

In the case of the operating unit 6 as shown in FIG. 1, when turning the adjustment screw portion 61 in the tightening direction, the movable body 40 moves toward the one end side in the both end directions. When turning the adjustment screw portion 61 in the loosening direction, the movable body 40 moves toward the other end side (i.e. the target side). Further, by fixing the rotation (turning) of the adjustment screw portion 61, a position of the movable body 40 is fixed, that is, the position of the emitter 3 is fixed.

Next, the target unit 70 has the target 7 facing to the electron generating portion 31 of the emitter 3 and a flange portion 70*a* supported by an end surface 22*a* of the opening 22 of the insulator 2.

As the target 7, various shapes or forms can be employed as long as the electron beam L1 emitted from the electron generating portion 31 of the emitter 3 collides and as shown in the drawings an X-ray L2 can be emitted. In the drawings, the target 7 has, at a portion facing to the electron generating portion 31 of the emitter 3, an inclined surface 71 that extends in an intersecting direction that inclines at a predetermined angle with respect to the electron beam L1. By the fact that the electron beam L1 collides with this inclined surface 71, the X-ray L2 is emitted in a direction (e.g. in the crossing direction of the vacuum chamber 1 as shown in the drawings) that is bent from an irradiation direction of the electron beam L1.

As the grid electrode 8, various shapes or forms can be employed as long as they are interposed between the emitter 3 and the target 7 as described above and they can properly control the electron beam L1 that passes thorough them. For instance, as shown in the drawings, the grid electrode 8 has an electrode portion (e.g. a mesh electrode portion) 81 extending in the crossing direction of the vacuum chamber 1 and having a passing hole 81*a* thorough which the electron beam L1 passes and the lead terminal 82 penetrating the insulator 2 (in the crossing direction of the vacuum chamber 1).

According to the X-ray apparatus 10 configured as described above, by properly operating the emitter supporting unit 4 (so as to move the movable body 40 in the both end directions) by turning the adjustment screw portion 61 of the operating unit 6 in the loosening and tightening directions, it is possible to change the distance between the electron generating portion 31 of the emitter 3 and the target 7. For instance, as shown in FIG. 2, in a state in which the electron generating portion 31 is moved from the dischargeable region m to the no-discharge region n and the field emission of the emitter 3 is suppressed, a desired regeneration process for the guard electrode 5, the target 7, the grid electrode 8 etc. can be performed. Further, as compared with the above-mentioned conventional device provided with the large diameter exhaust pipe, size reduction can be readily achieved, and also reduction in man-hour of manufacturing and reduction in product cost can be realized.

<<An Example of Regeneration Process for Guard Electrode Etc. And Field Emission Method of X-Ray Apparatus 10>>

When performing the regeneration process for the guard electrode 5 etc. of the X-ray apparatus 10, first, by operating the emitter supporting unit 4 by the turning of the adjustment screw portion 61 of the operating unit 6 in the tightening direction, the movable body 40 is moved to the one end side, and the emitter 3 is moved to the no-discharge region n as shown in FIG. 2, then the state in which the field emission of the electron generating portion 31 is suppressed is set. In this state, both of the electron generating portion 31 of the emitter 3 and the edge portion 52 (in the case of FIG. 3, the small diameter portion 51) of the guard electrode 5 are separate from each other (the emitter 3 is moved to the no-discharge region so as to be a discharge electric field or less). By properly applying a predetermined regeneration voltage between the guard electrode 5 and the grid electrode 8 (the lead terminal 82) and/or between the target 7 and the grid electrode 8 in this state shown in FIG. 2, discharge is repeated at the guard electrode 5 etc., then the guard electrode 5 etc. undergo the regeneration process (the surface of the guard electrode 5 melts or dissolves and is smoothed out).

As the field emission method after the above regeneration process, by operating the emitter supporting unit 4 by the turning of the adjustment screw portion 61 of the operating unit 6 in the loosening direction, the movable body 40 is moved to the other end side, and the emitter 3 is moved from the no-discharge region n to the dischargeable region m as shown in FIG. 1, then the state in which the field emission of the electron generating portion 31 is possible is set. In this state, the electron generating portion 31 of the emitter 3 and the edge portion 52 of the guard electrode 5 are positioned close to each other or contact each other, then the dispersion of the electron beam L1 emitted from the emitter 3 is suppressed.

By applying a predetermined voltage between the emitter 3 and the target 7 with the electron generating portion 31 of the emitter 3 and the guard electrode 5 being at the same potential in this state shown in FIG. 1, electrons are generated from the electron generating portion 31 of the emitter 3 and the electron beam L1 is emitted, and the electron beam L1 collides with the target 7, then the X-ray L2 is emitted from the target 7.

By the regeneration process as described above, it is possible to suppress the flashover phenomenon (generation of the electrons) from the guard electrode 5 etc. in the X-ray apparatus 10, thereby stabilizing the quantity of generation of the electron of the X-ray apparatus 10. Further, the electron beam L1 can become a converging electron beam, and this easily brings the X-ray L2 to a focus, then high radioscopy resolution can be obtained.

Further, as for the field emission method, when moving the emitter 3 to the dischargeable region m as described above, the discharge distance d between the electron generating portion 31 of the emitter 3 and the edge portion 52 of the guard electrode 5 is properly adjusted by the operating unit 6. It is therefore possible to adjust and set the current output to the desired magnitude.

Embodiment 2 of Electric Field Radiation Device

Figure 5:
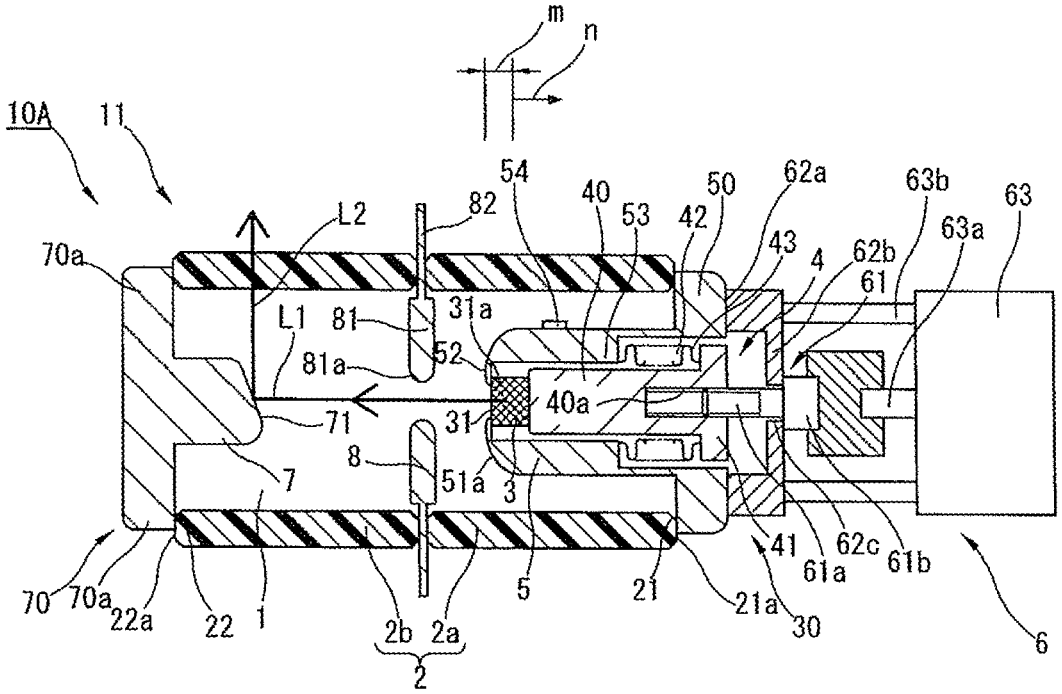
FIG. 5 is a schematic explanatory drawing showing an X-ray apparatus 10A according to an embodiment of the present invention (a sectional view cut in both end directions of a vacuum chamber 1 (in a case where an emitter 3 is positioned in a dischargeable region m)).

A reference sign 10A in FIG. 5 is another example of an X-ray apparatus to which the electric field radiation device of the present embodiment is applied. Here, in FIG. 5, the same element or component as that of FIGS. 1 to 4A and 4B is denoted by the same reference sign, and its explanation will be omitted below.

The X-ray apparatus 10A has the same configuration as that of the X-ray apparatus 10, and the operating unit 6 has a motor 63 for turning the adjustment screw portion 61. The motor 63 is fixed to and retained by a circumferential edge side of the bottom 62*b* of the bearing portion 62 at a predetermined distance away from one end side of the adjustment screw portion 61 by brazing etc. through an insulative tubular column 63*b* so that a drive shaft 63*a* is positioned concentrically with a screw shaft of the adjustment screw portion 61. Further, the drive shaft 63*a* of the motor 63 and the screw head 61*b* of the adjustment screw portion 61 are joined together through an insulator (such as insulation coupling) 63*c*.

According to the X-ray apparatus 10A configured as described above, by properly operating the emitter supporting unit 4 (so as to move the movable body 40 in the both end directions) by turning the adjustment screw portion 61 of the operating unit 6 in the loosening and tightening directions by a driving force of the motor 63, it is possible to change the distance between the electron generating portion 31 of the emitter 3 and the target 7. Then, in the same manner as the X-ray apparatus 10 (for instance, as shown in FIG. 2), in a state in which the electron generating portion 31 is moved from the dischargeable region m to the no-discharge region n and the field emission of the emitter 3 is suppressed, a desired regeneration process for the guard electrode 5, the target 7, the grid electrode 8 etc. can be performed. Further, as compared with the above-mentioned conventional device provided with the large diameter exhaust pipe, size reduction can be readily achieved, and also reduction in man-hour of manufacturing and reduction in product cost can be realized.

<<An Example of Regeneration Process for Guard Electrode Etc. And Field Emission Method of X-Ray Apparatus 10A>>

When performing the regeneration process for the guard electrode 5 etc. of the X-ray apparatus 10A, by operating the emitter supporting unit 4 by the turning of the adjustment screw portion 61 of the operating unit 6 in the tightening direction by the driving force of the motor 63, the movable body 40 is moved to the one end side, and the emitter 3 is moved to the no-discharge region n in the same manner as the X-ray apparatus 10 (as shown in FIG. 2), then the state in which the field emission of the electron generating portion 31 is suppressed is set. Further, by properly applying a predetermined regeneration voltage between the guard electrode 5 and the grid electrode 8 (the lead terminal 82) and/or between the target 7 and the grid electrode 8, the guard electrode 5 etc. undergo the regeneration process (the surface of the guard electrode 5 melts or dissolves and is smoothed out).

As the field emission method after the above regeneration process, by operating the emitter supporting unit 4 by the turning of the adjustment screw portion 61 of the operating unit 6 in the loosening direction by the driving force of the motor 63, the movable body 40 is moved to the other end side, and the emitter 3 is moved from the no-discharge region n to the dischargeable region m in the same manner as the X-ray apparatus 10 (as shown in FIG. 1), then the state in which the field emission of the electron generating portion 31 is possible is set.

By the regeneration process as described above, in the same manner as the X-ray apparatus 10, it is possible to suppress the flashover phenomenon (generation of the electrons) from the guard electrode 5 etc. in the X-ray apparatus 10A, and stabilize the quantity of generation of the electron of the X-ray apparatus 10A. Further, the electron beam L1 can become a converging electron beam, and this easily brings the X-ray L2 to a focus, then high radioscopy resolution can be obtained.

Further, as for the field emission method, when moving the emitter 3 to the dischargeable region m as described above, the discharge distance d between the electron generating portion 31 of the emitter 3 and the edge portion 52 of the guard electrode 5 is properly adjusted by the operating unit 6. It is therefore possible to adjust and set the current output to the desired magnitude.

Embodiment 3 of Electric Field Radiation Device

Figure 6:
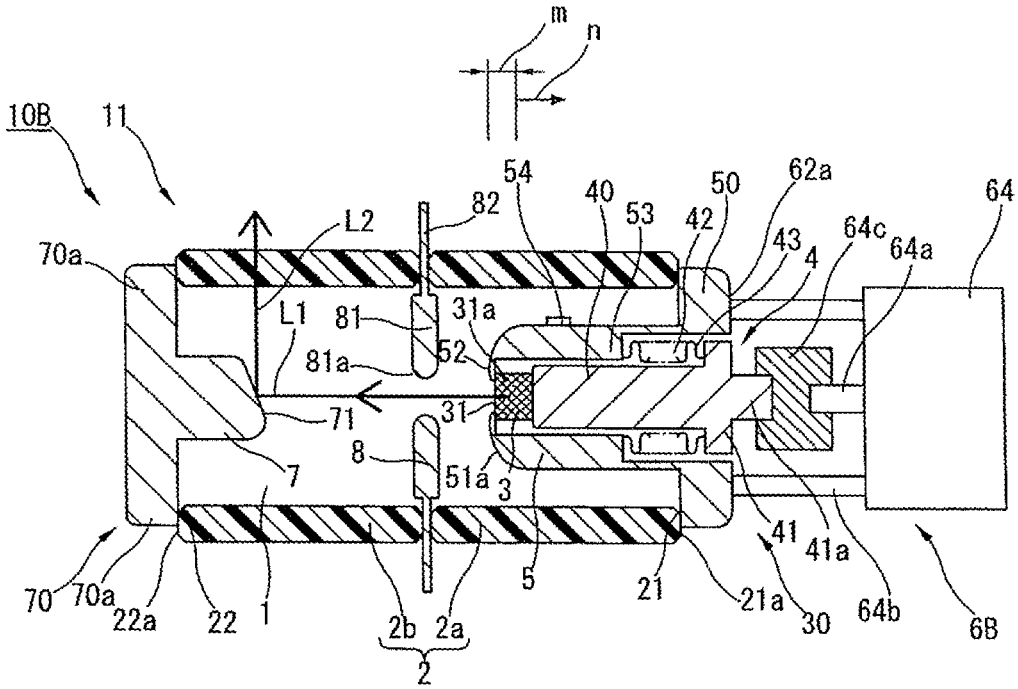
FIG. 6 is a schematic explanatory drawing showing an X-ray apparatus 10B according to an embodiment of the present invention (a sectional view cut in both end directions of a vacuum chamber 1 (in a case where an emitter 3 is positioned in a dischargeable region m)).

A reference sign 10B in FIG. 6 is other example of an X-ray apparatus to which the electric field radiation device of the present embodiment is applied. Here, in FIG. 6, the same element or component as that of FIGS. 1 to 4A and 4B is denoted by the same reference sign, and its explanation will be omitted below.

The X-ray apparatus 10B is different from the X-ray apparatuses 10 and 10A to which the operating unit 6 by the screw mechanism is applied. The X-ray apparatus 10B has a configuration employing an operating unit 6B by a reciprocating mechanism, for instance, like an air cylinder 64 shown in FIG. 6.

This operating unit 6B has the air cylinder 64 that reciprocates the movable body 40 of the emitter supporting unit 4 in the both end directions. The air cylinder 64 is fixed to and retained by the flange portion 50 at a predetermined distance away from the one end side of the movable body 40 (in the drawing, away from a protrusion 41*a* located at an inner circumferential side of the flange portion 41) by brazing etc. through an insulative tubular column 64*b* so that a shaft of a piston 64*a* is positioned so as to extend along an axis of the movable body 40 (in FIG. 6, so that the shaft of the piston 64*a* is positioned concentrically with the axis of the movable body 40). Further, the piston 64*a* and the movable body 40 (the protrusion 41*a* in the drawing) are joined together through an insulator 64*c*.

According to the X-ray apparatus 10B configured as described above, by properly operating the emitter supporting unit 4 (so as to move the movable body 40 in the both end directions) by reciprocating the piston 64*a* of the operating unit 6B in the both end directions by the reciprocating motion of the air cylinder 64, it is possible to change the distance between the electron generating portion 31 of the emitter 3 and the target 7. Then, in the same manner as the X-ray apparatus 10 (for instance, as shown in FIG. 2), in a state in which the electron generating portion 31 is moved from the dischargeable region m to the no-discharge region n and the field emission of the emitter 3 is suppressed, a desired regeneration process for the guard electrode 5, the target 7, the grid electrode 8 etc. can be performed. Further, as compared with the above-mentioned conventional device provided with the large diameter exhaust pipe, size reduction can be readily achieved, and also reduction in man-hour of manufacturing and reduction in product cost can be realized.

<<An Example of Regeneration Process for Guard Electrode Etc. And Field Emission Method of X-Ray Apparatus 10B>>

When performing the regeneration process for the guard electrode 5 etc. of the X-ray apparatus 10B, by retracting the piston 64*a* of the operating unit 6B into the air cylinder 64 by the reciprocating motion of the air cylinder 64, the movable body 40 is moved to the one end side, and the emitter 3 is moved to the no-discharge region n in the same manner as the X-ray apparatus 10 (as shown in FIG. 2), then the state in which the field emission of the electron generating portion 31 is suppressed is set. Further, by properly applying a predetermined regeneration voltage between the guard electrode 5 and the grid electrode 8 (the lead terminal 82) and/or between the target 7 and the grid electrode 8, the guard electrode 5 etc. undergo the regeneration process (the surface of the guard electrode 5 melts or dissolves and is smoothed out).

As the field emission method after the above regeneration process, by extracting the piston 64*a* of the operating unit 6B from the air cylinder 64 by the reciprocating motion of the air cylinder 64, the movable body 40 is moved to the other end side, and the emitter 3 is moved from the no-discharge region n to the dischargeable region m in the same manner as the X-ray apparatus 10 (as shown in FIG. 1), then the state in which the field emission of the electron generating portion 31 is possible is set.

By the regeneration process as described above, in the same manner as the X-ray apparatus 10, it is possible to suppress the flashover phenomenon (generation of the electrons) from the guard electrode S etc. in the X-ray apparatus 10B, and stabilize the quantity of generation of the electron of the X-ray apparatus 10B. Further, the electron beam L1 can become a converging electron beam, and this easily brings the X-ray L2 to a focus, then high radioscopy resolution can be obtained.

Further, as for the field emission method, when moving the emitter 3 to the dischargeable region m as described above, the discharge distance d between the electron generating portion 31 of the emitter 3 and the edge portion 52 of the guard electrode 5 is properly adjusted by the operating unit 6B. It is therefore possible to adjust and set the current output to the desired magnitude.

Although the embodiments of the present invention have been explained in detail, the present invention can be modified within technical ideas of the present invention. Such modifications belong to scope of claims.

For instance, in a case where heat is generated due to collision of the electron beam with the target, the electric field radiation device of the present invention could be configured to cool the electric field radiation device using a cooling function. As the cooling function, various ways such as air cooling, water cooling and oil cooling are used. In the case of the cooling function using the oil cooling, for instance, the electric field radiation device is immersed or submerged in cooling oil in a certain case. Further, a degassing or deaerating operation (using a vacuum pump) could be properly carried out in the submerged state.

As a method of maintaining air tightness (high vacuum) of the vacuum chamber of the vacuum enclosure, each element or component (such as the insulator, the emitter unit, the target unit etc.) that forms the vacuum enclosure could be integrally brazed. However, as long as air tightness (high vacuum) of the vacuum chamber of the vacuum enclosure can be maintained, various ways can be used.

Although the vacuum pressure of the vacuum chamber is exerted to the emitter supporting unit and the operating unit, various shapes or forms can be employed as long as they can support the emitter movably in the both end directions of the vacuum chamber and move and fix the emitter to a desired position (the dischargeable region or the no-discharge region) by the operation through the operating unit.

For instance, in the case where the operating unit is configured by the reciprocating mechanism, as long as the reciprocating mechanism has the piston that can reciprocate along the axis of the movable body and is connected to the one end side of the movable body, and the movable body moves in the both end directions by the reciprocating motion of the piston by the operating unit, then the distance between the electron generating portion of the emitter and the target is changed and the position of the emitter can be fixed at an arbitrary distance, various reciprocating mechanisms can be employed. When explaining this with the X-ray apparatus 10B taken as an example, instead of the mechanism using the reciprocating motion of the piston 64*a* of the air cylinder 64, a mechanism (not shown) using reciprocating motion of a piston (mover etc.) of a voice coil motor could be employed. This can obtain the same working and effect as those of the embodiment 3.

Further, it is possible to employ a configuration having a restraining unit that restrains the movement of the emitter so that the emitter does not move to the target side across the dischargeable region. By this restraining unit, even in the case where the emitter positioned in the dischargeable region contacts the guard electrode, a contact pressure can be lowered. It is therefore possible to prevent deformation of shapes of the emitter and the guard electrode etc., and to maintain desired characteristics of the electric field radiation device.

Furthermore, a configuration, in which an operator can feel a click when the emitter is moved to the predetermined position (the dischargeable region or the no-discharge region) by operation of the emitter supporting unit by the operating unit, could be used. With this configuration, it is possible to readily and quickly get the predetermined position of the emitter when operating the emitter supporting unit by the operating unit. This contributes to, for instance, improvement in operability of operating unit.

Moreover, a fixing unit that properly fixes the emitter at the predetermined position, i.e. a fixing unit that fixes the operation of the operating unit, could be employed. With this configuration, even if an unintentional external force (e.g. in the case of the configuration having the cooling function using the oil cooling, a suction force of the vacuum pump which may act on the supporting unit upon deaerating operation of the cooling oil) acts on the emitter or the emitter supporting unit or the operating unit, it is possible to prevent the emitter from shifting from the predetermined position. Therefore, the field emission in the electric field radiation device and the regeneration process for the guard electrode etc. can be properly realized. This fixing manner is not especially limited, but various shapes or forms can be employed. When explaining the fixing manner with the X-ray apparatus 10 taken as an example, a stopper that can fix the turning of the adjustment screw portion 61 of the operating unit 6 in the loosening and tightening directions could be employed.

In addition, in order to achieve a smooth movement of the emitter supporting unit, a guide that guides the movement of the emitter supporting unit could be provided. For instance, when explaining this with the X-ray apparatus 10 taken as an example, a guide that guides the movable body 40 in the both end directions while suppressing a rotation in a circumferential direction of the axis of the movable body 40 (so that the movable body 40 does not rotate together with the operation of the operating unit 6) could be employed.

The invention claimed is:

1. An electric field radiation device comprising:

a vacuum enclosure formed by sealing a tubular insulator at a first end and a second end to form a vacuum chamber at an inner wall side of the insulator;

an emitter positioned at the first end of the vacuum chamber and having an electron generating portion disposed to face the second end of the vacuum chamber;

a guard electrode arranged at an outer circumferential side of the electron generating portion of the emitter;

a target positioned at the second end of the vacuum chamber and disposed to face to the electron generating portion of the emitter;

a movable emitter supporting unit configured to move the emitter in both end directions of the vacuum chamber; and an operating unit connected to the emitter supporting unit and configured to operate the emitter supporting unit, wherein the operating unit is configured to change a distance between the electron generating portion of the emitter and the target and fix a position of the emitter at an arbitrary distance by operation of the emitter supporting unit, wherein the guard electrode comprises, at a target side thereof, a small diameter portion which the electron generating portion of the emitter contacts and separates from, and the electron generating portion of the emitter performs field emission with the position of the emitter fixed.

2. The electric field radiation device as claimed in claim 1, wherein:

the emitter supporting unit supports the emitter through a movable body that is movable, by the operating unit, in both end directions of the vacuum chamber, the operating unit has an adjustment screw portion comprising a screw shaft screwed into and connected to a first side of the movable body so as to extend in a same direction as an axis of the movable body and rotatably retained by the first side of the movable body, and the movable body moves in both end directions by turning of the adjustment screw portion by the operating unit, the distance between the electron generating portion of the emitter and the target is changed, and the position of the emitter is fixed at the arbitrary distance.

3. The electric field radiation device as claimed in claim 2, wherein:

a motor for turning the adjustment screw portion is connected to the adjustment screw portion through an insulator.

4. The electric field radiation device as claimed in claim 2, wherein:

the movable body has a shape that extends in both end directions of the vacuum chamber at an opposite side to the electron generating portion of the emitter.

5. The electric field radiation device as claimed in claim 1, wherein:

the emitter supporting unit supports the emitter through a movable body that is movable, by the operating unit, in both end directions of the vacuum chamber, the operating unit has a piston that can reciprocate along an axis of the movable body that is connected to a first side of the movable body, and the movable body moves in both end directions by reciprocating motion of the piston by the operating unit, the distance between the electron generating portion of the emitter and the target is changed, and the position of the emitter is fixed at the arbitrary distance.

6. The electric field radiation device as claimed in claim 5, wherein:

the piston is connected to the movable body through an insulator.

7. The electric field radiation device as claimed in claim 1, wherein:

the guard electrode comprises, at a target side thereof, an edge portion that extends in a crossing direction of the vacuum chamber and overlaps with a circumferential edge portion of the electron generating portion of the emitter in both end directions of the vacuum chamber.

8. The electric field radiation device as claimed in claim 1, further comprising:

bellows that can expand and contract in both end directions of the vacuum chamber, and wherein a first side of the bellows is retained by the emitter supporting unit, and a second side of the bellows is retained by the vacuum enclosure.

9. The electric field radiation device as claimed in claim 1, wherein:

a grid electrode is provided between the emitter and the target in the vacuum chamber.

10. A field emission method of the electric field radiation device as claimed in claim 1, comprising:

setting an output of a field emission current by changing the distance between the electron generating portion of the emitter and the target and by fixing the position of the emitter at the arbitrary distance by operation of the operating unit; and performing field emission from the electron generating portion of the emitter with the position of the emitter fixed.

11. The field emission method of the electric field radiation device as claimed in claim 10, wherein:

the output of the field emission current is set without changing a tube voltage.

* * * * *